US009975023B2

(12) United States Patent
Goldstein

(10) Patent No.: US 9,975,023 B2
(45) Date of Patent: May 22, 2018

(54) TOWEL RACK FOR USE DURING SPORTS EVENT

(71) Applicant: Group One Limited, Ramsey (GB)

(72) Inventor: Fredric Goldstein, Nacka (SE)

(73) Assignee: GROUP ONE LIMITED, Ramsey, British Isles (IM)

( * ) Notice: Subject to any disclaimer, the term of this patent is extended or adjusted under 35 U.S.C. 154(b) by 0 days. days.

(21) Appl. No.: 14/351,725

(22) PCT Filed: Sep. 27, 2012

(86) PCT No.: PCT/US2012/057403
§ 371 (c)(1),
(2) Date: Apr. 14, 2014

(87) PCT Pub. No.: WO2013/055522
PCT Pub. Date: Apr. 18, 2013

(65) Prior Publication Data

US 2014/0231369 A1 Aug. 21, 2014

Related U.S. Application Data

(60) Provisional application No. 61/564,496, filed on Nov. 29, 2011, provisional application No. 61/546,589, filed on Oct. 13, 2011.

(51) Int. Cl.
*A63B 61/00* (2006.01)
*A63B 71/06* (2006.01)
(Continued)

(52) U.S. Cl.
CPC ..... *A63B 61/00* (2013.01); *A47K 10/10* (2013.01); *A63B 61/003* (2013.01);
(Continued)

(58) Field of Classification Search
CPC ..... A47L 10/00; A47L 10/02; A47L 10/025; A47L 10/04; A47L 10/06; A47L 10/08;
(Continued)

(56) References Cited

U.S. PATENT DOCUMENTS 113,398 A * 4/1871 Chandler ..... A47K 10/04 211/88.04
601,550 A * 3/1898 Broughton ..... A47K 10/04 211/16

(Continued)

FOREIGN PATENT DOCUMENTS

EP 1750240 A1 2/2007
JP 2006223432 8/2006

(Continued)

OTHER PUBLICATIONS

International Search Report and Written Opinion dated Mar. 19, 2013.

(Continued)

*Primary Examiner* — Joshua E Rodden
(74) *Attorney, Agent, or Firm* — Carlson, Gaskey & Olds, P.C.

(57) ABSTRACT

Disclosed is a towel rack for use during a tennis or other sports event. In one example, the towel rack includes a support for supporting a towel, and at least one display panel for displaying a message. In a disclosed method, a message is displayed during the sports event, and the towel is placed on the support such that the message is unobstructed by the towel.

2 Claims, 10 Drawing Sheets

(51) Int. Cl.

| | |
|---|---|
| ***G09F 9/00*** | (2006.01) |
| ***G09F 23/00*** | (2006.01) |
| ***A63B 71/00*** | (2006.01) |
| ***G09F 9/30*** | (2006.01) |
| ***A47K 10/10*** | (2006.01) |

(52) U.S. Cl.
CPC ..... *A63B 71/0036* (2013.01); *A63B 71/0619* (2013.01); *G09F 9/30* (2013.01); *G09F 23/00* (2013.01); *G09F 23/0066* (2013.01)

(58) Field of Classification Search
CPC ..... A47L 10/10; A63B 61/00; A63B 61/003; A63B 71/0036; A63B 71/0619; G09F 9/30; G09F 23/00; G09F 23/0066
USPC ... 211/13.1, 54.1, 57.1, 59.1, 85.3, 85.7, 50, 211/52, 55, 59.2, 128.1; 40/654, 657
See application file for complete search history.

(56) References Cited

U.S. PATENT DOCUMENTS 828,566 A * 8/1906 McDonald ..... A47K 10/025 312/34.1
1,117,747 A * 11/1914 Adams ..... A47K 10/025 221/29
1,157,046 A * 10/1915 Rousso ..... A47K 10/025 312/34.4
1,161,955 A * 11/1915 Nicholas ..... A47F 5/0823 211/59.1
1,225,390 A * 5/1917 Anderson ..... A47K 10/025 221/250
1,240,620 A * 9/1917 Stockton ..... A47K 10/025 211/6
1,256,274 A * 2/1918 Steiner ..... A47K 10/025 221/29
1,267,414 A * 5/1918 Hubinger ..... A47K 10/025 211/6
1,290,950 A * 1/1919 Fetherolf ..... A47K 10/025 211/45
1,292,512 A * 1/1919 Rank ..... A47K 10/025 211/6
1,295,578 A * 2/1919 Olson ..... A47K 10/025 221/27
1,299,630 A * 4/1919 Solomon ..... A47K 10/025 221/281
1,305,048 A * 5/1919 Bagley ..... A47K 10/025 221/103
1,524,704 A * 2/1925 Fore ..... A47K 10/04 211/88.01
2,060,630 A * 11/1936 Mertel ..... A47K 10/04 211/6
2,244,833 A * 6/1941 Forman ..... A47K 10/025 220/DIG. 29
2,971,266 A * 2/1961 Silva ..... A47K 10/06 219/521
3,866,336 A * 2/1975 Bereza ..... D06F 58/10 34/201
4,865,205 A * 9/1989 Thorneburg ..... A47F 7/10 211/59.1
5,666,743 A * 9/1997 Dawson ..... A47L 23/205 34/202
5,688,023 A 11/1997 Blocker, Jr.
6,055,414 A * 4/2000 Javitt ..... H04W 84/025 455/226.2
6,189,346 B1 * 2/2001 Chen ..... D06F 58/10 68/205 R
6,816,130 B1 * 11/2004 Shishido ..... A63B 71/06 345/1.2
6,860,032 B2 * 3/2005 Meyer ..... D06F 58/10 34/202
2001/0035671 A1 11/2001 Brooks
2009/0108647 A1 4/2009 Bowman
2009/0266777 A1 * 10/2009 Porter, Sr. ..... A47F 7/0021 211/85.7
2013/0063326 A1 * 3/2013 Riegel ..... G09F 9/33 345/4

FOREIGN PATENT DOCUMENTS

KR 200311147 4/2003
KR 100857459 9/2008
KR 1020100131256 12/2010

OTHER PUBLICATIONS

International Preliminary Report on Patentability dated Mar. 4, 2014.
European Search Report for EP Application 12839679.3 dated May 11, 2015.

* cited by examiner

TOWEL RACK FOR USE DURING SPORTS EVENT

RELATED APPLICATIONS

This application claims the benefit of U.S. Provisional Application No. 61/546,589, filed 13 Oct. 2011, and U.S. Provisional Application No. 61/564,496, filed 29 Nov. 2011, the entirety of which are herein incorporated by reference.

BACKGROUND

During organized or professional tennis matches, a tennis player uses a towel between most points. Typically, as the player returns to court after the changeover, a ball boy is handed the towel by the player at the far end of the court. The ball boy, in the absence of a dedicated or specified structure, randomly places it somewhere, retrieves the towel when signaled by the player between points, hands it to the player for use, receives it back, where the ball boy again arbitrarily places the towel at a spot at the back of the court, either on some backdrop, a sponsor display, a line umpire chair, a display clock (such as Rolex®), or even on the court surface itself, as but a few examples.

The ball boy typically stands in readiness, however, at a location away from the placement of the towel. To retrieve the towel for the player, the ball boy must first run to the line umpire chair before heading to the players, which results in lost time. The ball boy must also return to the ready position outside the playing area as quickly as possible, and therefore has less time to properly place a towel on the chair.

The ball boy is typically also instructed to spread out the towel before handing it to the player, shortening the time the player will need to dry himself off. This may require some delay in handing the towel to the player, as the towel is seldom placed such that it is neatly spread out between points. Even during the same match, at each end of the court, the towel may be in different locations and, as the ball boys are typically rotated, the towel will further be found randomly in more than one spot. In this case, the player will not immediately know which ball boy to signal when the towel is desired, resulting at times in delay between points. The placement of the towel on a line umpire chair also requires the ball boy to maneuver around the line umpire who stands right in front of the chair. The chair may further sit within a closed box, further adding a degree of awkwardness in placing the towel neatly on the chair.

In terms of appearance, a sweat drenched towel in full view of television viewers, often in close ups and lying in rumpled disarray in any of the aforementioned locations, is not aesthetically pleasing and reduces the attractiveness of tennis as a global sport.

Most professional tennis tournaments are played outdoors. Some, such as the Australian Open during summer months, can reach on court temperatures exceeding 40° C. (104° F.). During changeovers, many players require shading from the sun and ice packs, so severe is the effect of the heat. Profuse sweating is a typical result. Heat affected players may take more time between points in order to recover, causing stoppage and delays in play and increasing match length.

Furthermore, the placement of a towel on a chair results in the line umpires sitting on a chair which had a sweat soaked towel laying upon it, and further results in the players wiping their faces with a towel which was lying on a chair which line umpires sit on during changeovers. In hot weather, this is especially unhygienic.

Finally, as throwing a towel upon a chair or back drop, where it lies in rumpled disarray during play, is not aesthetically pleasing to both live spectators and television viewers, the solution to this problem presents unique advertising opportunities to sponsors and tennis tournaments, as described in the instant application.

SUMMARY

As towel rack according one non-limiting embodiment of this disclosure includes a support for supporting a towel, and at least one display panel for displaying a message, such as a sponsor message, a time, or some other type of information.

A method according to a non-limiting embodiment of this disclosure includes providing a towel rack having a support and at least one display panel. The method further includes displaying a message on the at least one display panel, and placing a towel on the support such that the message is unobstructed by the towel.

These and other features of the present disclosure can be best understood from the following drawings and detailed description.

BRIEF DESCRIPTION OF THE DRAWINGS

The drawings can be briefly described as follows.

DETAILED DESCRIPTION

An exemplary towel rack 10 is shown across the various figures. Turning to FIGS. 1-4 in particular, the towel rack 10 includes a support section 12, a base section 14 and a plurality of display panels 16*a*-16*b*. In this example, the support section 12 is fastened to the base section 14, which is in turn fastened to the plurality of display panels 16*a*-16*b*. This disclosure extends to other types of towel racks, however, including those provided by separate, or separable, components, as will be appreciated from the below description. In one example, the towel rack 10, whether provided by separate components or not, is a dedicated structure for supporting a towel T thereon.

Figure 1:
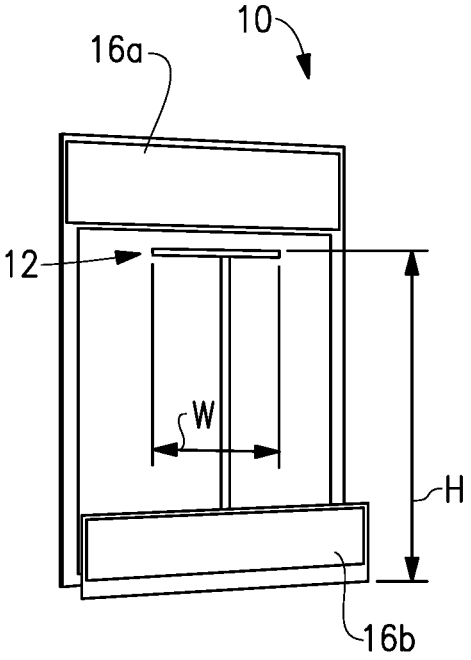
FIG. 1 is a front-perspective view of an example towel rack.
Figure 2:
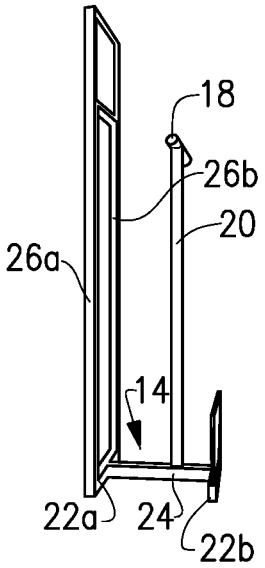
FIG. 2 is a side-perspective view of the towel rack of FIG. 1.
Figure 3:
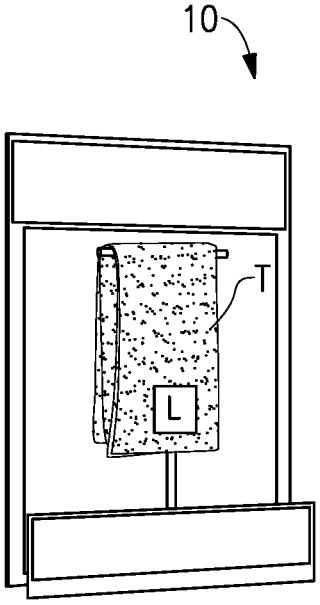
FIG. 3 is front-perspective view of the towel rack of FIG. 1 with a towel supported thereon.
Figure 4:
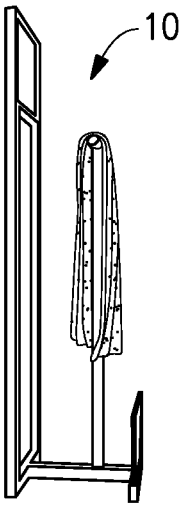
FIG. 4 is a side-perspective view of the towel rack of FIG. 1 with a towel supported thereon.

The support section 12 includes a towel support 18, here illustrated as a towel bar, supported by a vertical pole, or post, 20. The towel support 18 is configured to support a towel T thereon. In this regard, the width W of the towel support 18 may be selected to correspond to an expected width of a particular towel T. Further, the height H of the pole 20 may be selected such that the towel support 18 supports the towel T below an upper display panel 16*a* and above a lower display panel 16*b*, as illustrated in FIGS. 3-4. In this manner, placing the towel T on the towel support 18 does not obstruct a view of either of the display panels 16*a*-16*b*. Further yet, if the towel T itself includes a logo L, the disclosed towel rack 10 allows for simultaneous viewing of the logo L and the display panels 16*a*-16*b*, as shown in FIG. 3.

While FIGS. 3-4 show support 18 supported by the vertical pole 20, the vertical pole 20 could act as the towel support 18. To this end, the towel support 18 could be arranged in any manner (either perpendicular, parallel, vertical, horizontal, etc.) as one would appreciate from below. In other words, the support 18 is not limited to any particular orientation.

Figure 5:
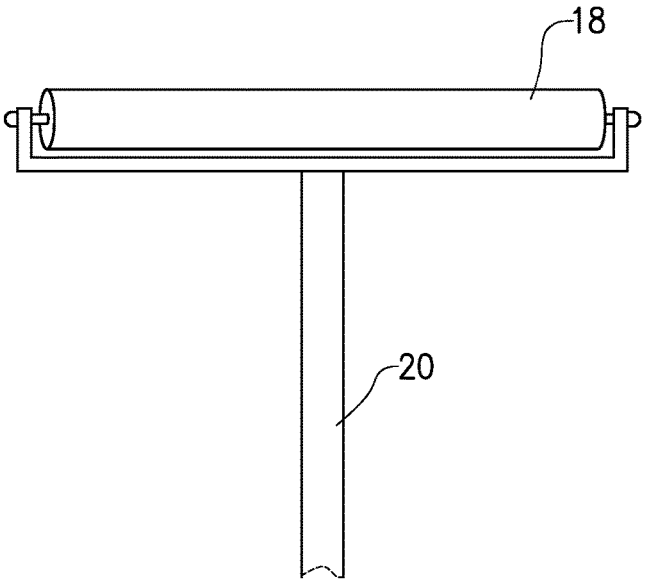
FIG. 5 illustrates an optional feature wherein a towel support is configured to rotate.

It is possible to configure the towel support 18 such that it rolls, or spins, about its long axis relative to the pole 20, as illustrated in FIG. 5. In this case, the chances of snagging the towel T on the towel support 18 or on the pole 20 during towel removal are reduced. A feature may be added to adjust the resistance of the towel support 18 to rotation, to allow a user to select a desired rotatability. In a further feature, the towel support 18 could be made of a rubber material which would prevent the towel T from slipping off in the event the towel T is not positioned evenly across the towel support 18.

Turning back to FIG. 2, the example base section 14 includes a plurality of lateral base supports 22*a*-22*b*, as well as a transverse base support 24, each of which works to provide the towel rack 10 with stability. While only one transverse base support 24 is shown, additional transverse supports can be included. In general, however, the lateral supports 22*a*-22*b* serve to prevent side-to-side tipping of the towel rack 10, whereas the transverse support 24 generally prevents tipping in a front-to-back direction. Further, rubber feet could be attached to the base section 14, increasing the stability thereof.

As one would appreciate, the dimensions of the towel rack 10 may affect the stability and functionality of the rack. For example, the length of the transverse base support 24 may be selected such that it is proportional to the height H of the towel support 18 and the display panel 16*a*. Further, pole 20 may be positioned offset from the display panel 16*b*, which will further add front-to-back stability to the towel rack 10, however the pole 20 should be positioned so that there is no obstruction in quickly placing the towel T on the towel support 18.

Figure 6:
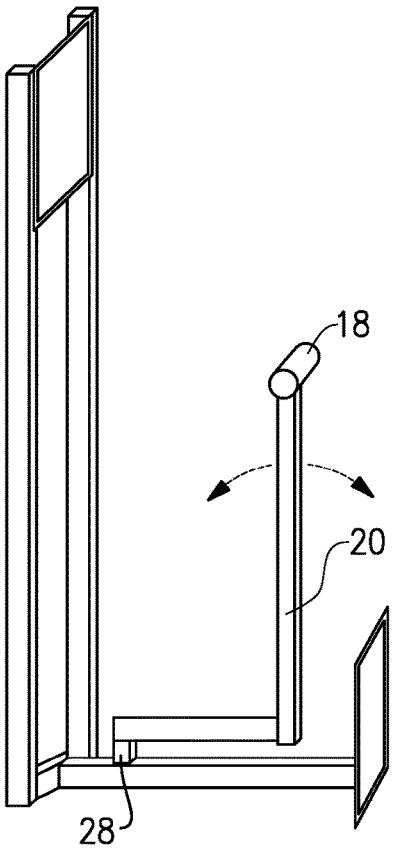
FIG. 6 illustrates an optional feature wherein a pole is configured generally in an L-shape and is associated with a flexible joint.

Turning to FIG. 6, an alternate pole 20 arrangement is illustrated. In this example, the pole 20 is connected further back on the transverse base support 24, but is provided with an "L-shape" such that the towel support 18 is in the same relative position as in the example of FIG. 1. This further increases the front-to-back stability of the towel rack 10. The pole may further include a flexible joint 28 such that any great tug would have the force projected into the joint 28 before working to tip the towel rack 10 over. Optionally, the entire pole 20 may be flexible.

Figure 7:
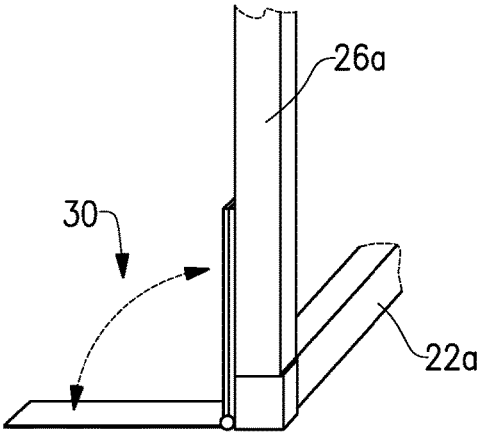
FIG. 7 illustrates an optional support feature for the towel rack.

The base section 14 provides the towel rack 10 with the stability to be a freestanding, mobile structure. That is, the towel rack 10 is not required to be permanently fixed to any larger structure for support, although it can be if desired. For example, the base section 14 may be provided with any locally available additional weights (e.g., such as water bottles or sand bags), or may be affixed (e.g., by way of screws or the like) to a surface (such as a wall, floor, or the tennis court itself) for added stability. Towards this, back supports 30, which may include rubber, may be hingeably connected to vertical display supports 26*a*-26*b* to slide under a backdrop or wall, or to support a counterweight thereon further increasing rack 10 stability, as generally illustrated in FIG. 7. It is also possible to make the entire towel rack 10 out of a material such as steel, with sufficient weight to provide the needed stability. It is further possible to make the base section 14 out of a material heavier than the remainder of the towel rack 10.

Figure 14:
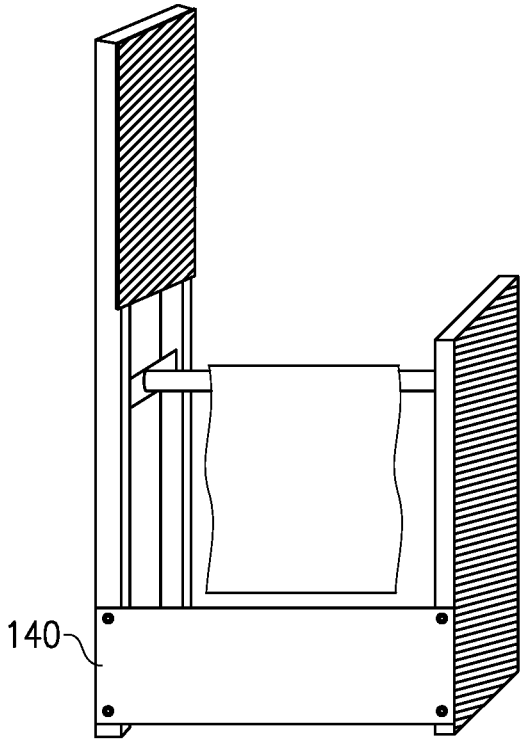
FIG. 14 is a side-perspective view of still another towel rack including a side display panel.

Upper and lower display panels 16*a*-16*b* may be configured, as explained above, to be positioned above and below the towel T when the towel T is placed on the towel support 18 but offset vertically, for the reasons as previously described. Vertical display supports 26*a*-26*b* may extend upwardly from a rear lateral base support 22*a* to support the upper display panel 16*a*. The lower display panel 16*b*, in the example, is positioned directly above a front lateral base support 22*b*. This way the towel T does not block viewing of either display panel 16*a*-16*b*. The display panels 16*a*-16*b* may display a message (here shown as a sponsor message including a corporate logo), such as an advertisement, or any other type of message. By way of an additional example, third and fourth display panels could be placed laterally to the base section 14 (as generally illustrated in FIG. 14), further increasing potential sponsor revenue. Additional display panels may be added to the towel rack 10 as desired.

It will be appreciated that the term "message" includes sponsor messages, and can further include messages such as the time of day, a length of time of a tennis match, a speed of a serve of a tennis ball, and any other relevant information that event organizers desire to convey to spectators, as examples. "Sponsor message," as used herein, includes a name, logo, advertisement, photo, etc., which promotes or represents a company, product, service, or brand name, generally for marketing or publicity purposes. In other words, the message could include at least one of (1) a sponsor message, (2) the time of day, (3) a length of time of a tennis match, and (4) a speed of a serve of a tennis ball. The message could further include a shot clock, or some other type of indicator providing information regarding the match.

Further, the vertical display supports 26*a*-26*b* may be hingeably connected to the base section 14 so as to increase the stability of the rack 10, and to direct the display panel 16*a* upwardly for increased viewing, if desired.

Figure 8:
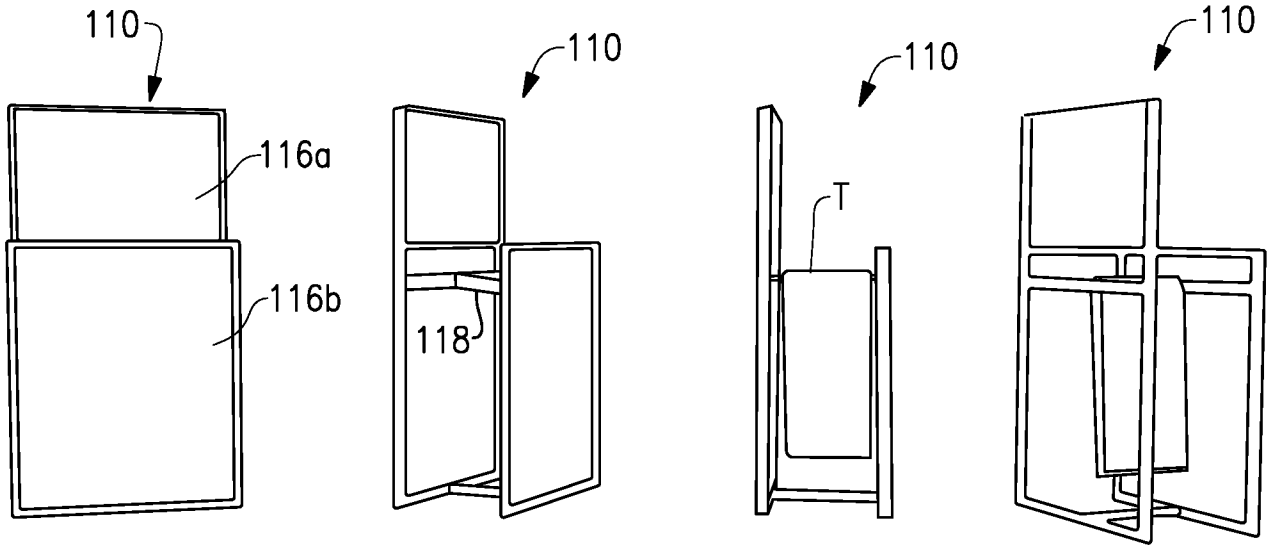
FIG. 8 includes multiple views of another example towel rack.

Additionally, the front display panel 16*b* may be larger than in the example shown, such that the display 16*b* completely obscures the view of the towel T from a front perspective, as illustrated in FIG. 8. In some instances, it may be preferred to essentially hide the towel T behind the display panel 16*b* (e.g., for aesthetic reasons).

Given that the towel rack 10 may be positioned on a tennis court during play (e.g., the towel rack 10 may be placed on the court and near, but spaced from, the playing area), both in-person and television spectators of the tennis match may be capable of viewing the display panels 16*a*-16*b*. Although the display panel 16*a*-16*b* may be relatively small in size (relative to typical advertisements associated with tennis matches), the relative visibility may be pronounced as a camera zooms in on a particular player between points, or as the camera tracks the ball boy as he gives the player his towel. The display panels 16*a*-16*b* could include LED screens, or other types of electronic display screens, or a display of the rotating variety for changing the display between games/sets. Further, the display panels could be boards, stickers, or any other type of panel configured to be removed from the towel rack 10 and replaced as needed, and need not be electronic screens.

In general, the towel rack 10 is configured for outdoor use to withstand wind and rain. As mentioned, the towel rack 10 may be made of steel, and can be further made of materials such as aluminum, plastic, carbon fiber, or any other suitable material. If a lightweight material is selected for the towel rack 10, additional weights can be added to the base section 14 (as generally noted above). This way, the towel rack 10 maintains the required stability when it is free standing.

Again, the disclosed towel rack 10 may be used on, or near, a tennis court during a tennis match. In particular, the towel rack 10 may be positioned near a ball boy at the far end of the court, or even near a player bench. In general, one may select a location for the towel rack 10 depending on the desired towel rack 10 visibility. In one example, the towel rack 10 is placed outside the doubles line of a tennis court, which is typically where the ball boys stand during points (so that they do not interfere with the line judges). Thus, the towel T will be well away from any playing area. This also puts the towel T in a consistent place where the ball boy knows to retrieve it, allowing for a speedier retrieval and possibly quicker play.

Accordingly, the disclosed towel rack 10 keeps a towel in a tidy fashion between points, while reducing the time and energy required to place and subsequently retrieve the towel (as the towel will be located in a single, convenient location). Spread out on the towel rack, the towel will stay fresher and dry quicker and therefore function better to absorb sweat for the players. Further, the incorporation of one or more of the display panels 16*a*-16*b* serves as an additional revenue generator for a tennis tournament, for example. It is possible that two towel racks will be used for each match (one for each player at each side), potentially adding to the promotional/advertising benefits of the display panels 16*a*-16*b*.

While the towel rack 10 has been discussed relative to the sport of tennis specifically, it is to be understood that this towel rack may be used with other sports outside of tennis, and may be used outside the world of sports altogether.

To the extent not otherwise described or shown, the embodiments illustrated across FIGS. 8-17*a* corresponds to the embodiments of FIGS. 1-7, with like parts having reference numerals preappended with a "1," unless specified otherwise below.

Figure 9A:
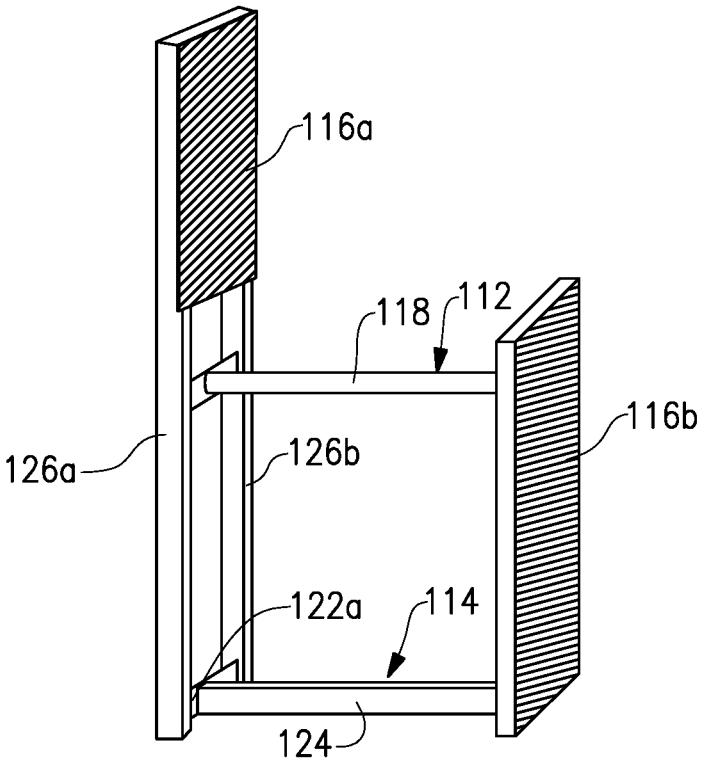
FIGS. 9*a*-9*b* are side-perspective views of the towel rack of FIG. 8.
Figure 9B:
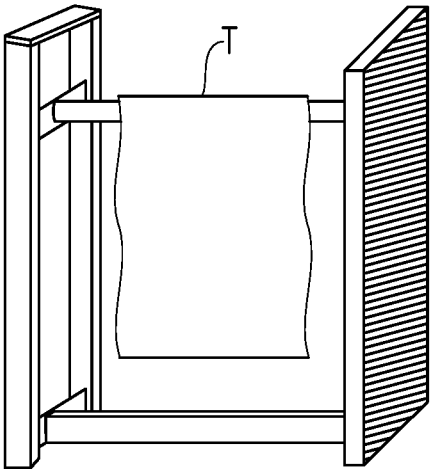

Turning to FIGS. 8-9*b*, a towel rack 110 includes a support section 112, a base section 114 and preferably a plurality of display panels 116*a*-*b*, which in this example are electronic display panels.

The support section 112 includes a towel support 118 supported above the base section 114. The towel support 118, here illustrated as a bar, is configured to support a towel T thereon in a position generally perpendicular to the display panels. In this regard, the width of the towel support 118 may be selected to correspond to an expected width of a towel T. In some configurations, as seen in FIG. 8, the front display panel 116*b* is of an increased size which will largely hide the towel T. This achieves at least three functions.

First, it allows for a larger and more visible display, increasing the potential value and revenue with regards to sponsors. Second, it will largely keep the towel T discretely out of public view during play, which may be considered to be of aesthetic value. And third, it allows for an increased stability by virtue of the towel support 118 being perpendicular to, and connecting, the back support to the front display panel.

The electronic displays 116*a*-16*b* could be separate screens showing separate images or, for example, could be synchronized to show one large image. Suitable electronics may be added to allow for the electrical requirements of the screens, including as well a remote or Bluetooth connection (or other wireless connection) to allow remote control of the brightness and/or video images which would be required during play.

The towel support 118 in its perpendicular orientation can further allow a ball boy, say, to more easily throw the towel over the towel support 118 from the side position, where the ball boy would normally stand after retrieving the towel from the player prior a new point commencing.

It will be appreciated that the structure supporting the towel may be of any shape and need not specifically be described as a single bar. The towel support 118 can be duplicated into a double bar, for example, which via greater exposed towel surface area would provide for quicker drying, as well as a wider target for quickly placing the towel. There can also be a net between the two bars which would catch the towel if the ball boy is unable to place the towel with enough care that it would not slip or fall off the towel support(s). Other examples could be a box, basket or a flat panel located below, or alternatively in place of, the towel support 118. Broadly speaking, the towel support may be any structure which can receive the towel for placement in between the player's use of the towel A further example for the towel support is a generally flat towel panel 149, as shown in FIG. 17*b*, and generally discussed below.

FIGS. 9*a* and 9*b* show the display panels as being preferably an electronic screen, which would allow more visible logos, as well as actual advertising videos or animated logos prior to the match start and during the changeovers. As the changeovers are 90 seconds, multiple sponsors could be obtained for the same stand, as the electronic panel could show, for example, three sponsors at 30 second intervals or, in the alternative, one sponsor per a predetermined number of games, further increasing revenue opportunities. The front display panel is of a height allowing two separate screens in the normal 16:9 dimension or one large screen positioned vertically. Where it is not preferred to have a higher structure 116*a* for example, the rack can include only the front display panel 116*b*, as illustrated in FIG. 9*b*.

It should be appreciated that the towel rack could be of any particular size and dimension, incorporating one or multiple display panels, in accordance with the specific needs of the tournament and the court upon which it will be located. A center court may require electronic display panels while an outer court, normally untelevised, may require only printed display panels. A combination of both electronic and printed display panels within the same towel rack may also be preferable, and where electronic display panels are employed, a Plexiglas sheet (or the like) may be used to protect the screen.

Figure 10:
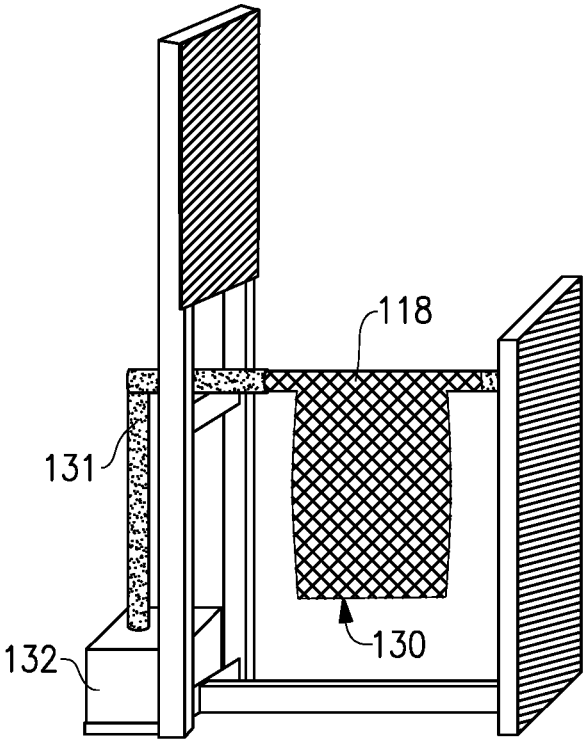
FIG. 10 is a side-perspective view of another example towel rack including a cooling plate.

FIG. 10 shows a cooling plate 130, incorporating (and may replace) towel support 118, which serves as a cooling surface and upon which the towel is placed. The refrigeration system 132 could provide cooling via pipes 131. Additionally, a blowing function could be added to cause air to blow out of the multiple openings in cooling plate 130 which would further cool the towel, as well as dry it. Such a feature during play in hot temperatures would provide relief to players (who otherwise need to wait until the changeover in order to use an ice pack). Any such respite would improve play as well as protect players from heat exhaustion.

Figure 11:
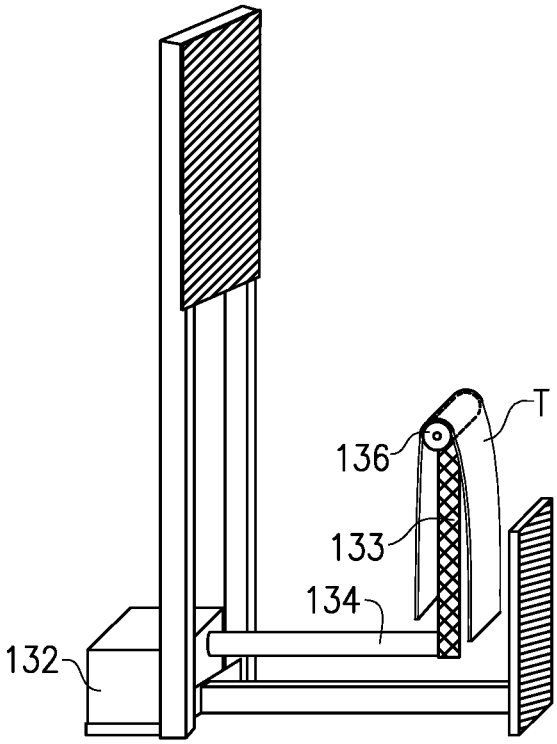
FIG. 11 is a side-perspective view of still another example towel rack including a cooling bar and tower.

FIG. 11 shows another configuration of a cooling system, whereby the cooling structure is the vertical post 133, together with towel support 136, which receive cool air from a refrigeration system 132 via a pipe 134. The cold air would blow out of the small openings of bars 133 and 136, cooling the towel T. While this solution is shown relative to a parallel towel support 136, it could be incorporated into the embodiments of FIGS. 8-10 and 12-14, in which the towel support 118 is positioned generally perpendicular to the display panels 116*a*-16*b*.

Figure 12:
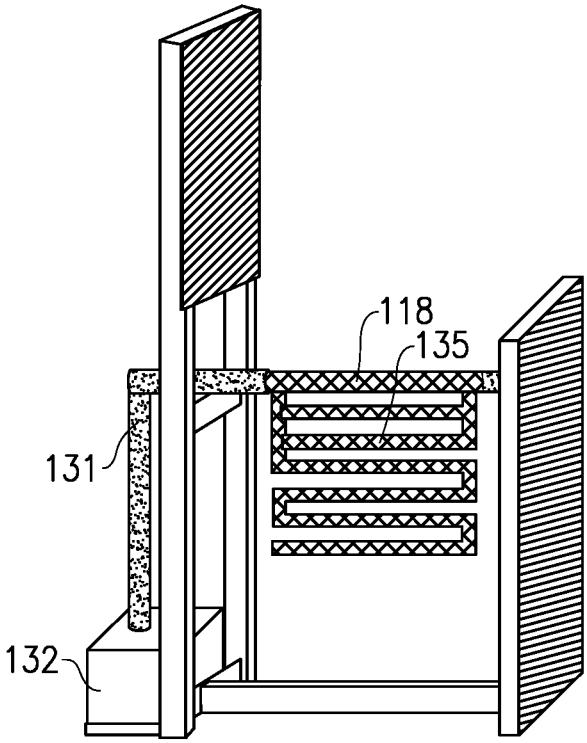
FIG. 12 is a side-perspective view of still another example towel rack including a cooling coil.

FIG. 12 shows a variation whereby the cooling plate is in the form of a coil 135, not unlike coils commonly found in bathrooms used to heat towels. Here, however, the coil serves to cool, not heat, the towel. The coil may preferably have openings to allow the escape of cool air on to the towel, as performed by a blowing structure within or separate from refrigeration system 132.

Figure 13:
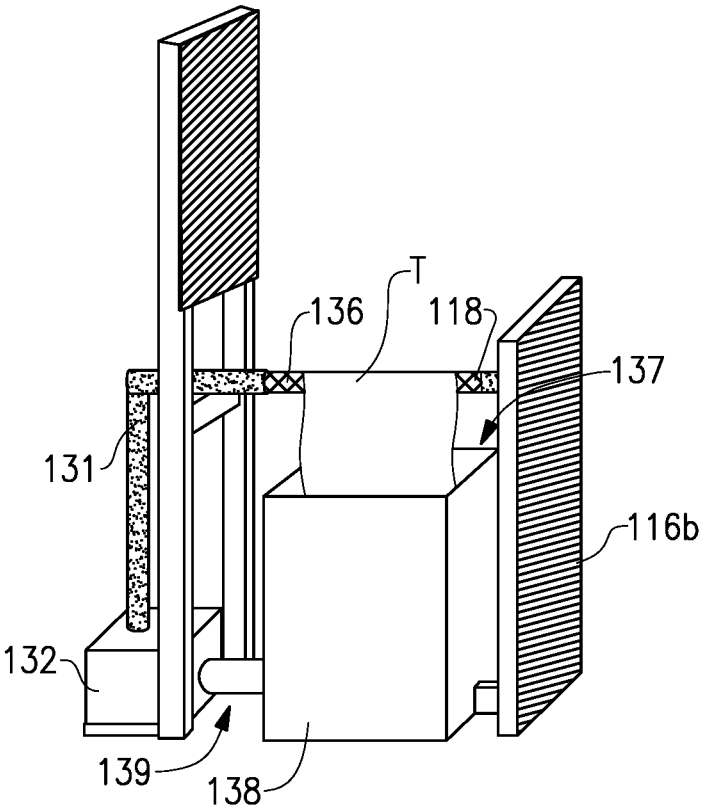
FIG. 13 is a side-perspective view of still another example towel rack including a cooling bar and box.

FIG. 13 shows yet another cooling configuration, whereby the towel T, in addition to being cooled by bar 136, as a part of towel support 118, via refrigeration system 132, will fall within a cooling box 138 or container, as fed via pipe 139. The walls of the cooling box 138 may contain small openings allowing cool air to be blown through by an air blower which circulates the cold air. An air blower outlet or fan within the cooling box 138 will contribute further to cooling down the towel by blowing the cold air at the bottom of the box upwards and unto the towel. A multiple of bars or any wider support could also be employed so that the towel is spread out wider, allowing more of the inside surface area to be reached by the cool air. The front display panel 116*b* is positioned and of a size where the cooling box 138 is hidden from view, especially to television viewers where the camera angle is typically from the end of the court. The cooling box, as seen by some spectators in the stadium or side camera angles, can have a logo visible on its side or a side display panel can separately conceal the cooling box 138. Further, means can be fitted to hold water within the cooling box 138 for either ball boys (who are typically youths more prone to dehydration) or even players to quickly sip cool water in lieu of toweling off (in light of the 120 second time allotted between points). The water could be kept accessible in any of the configurations across FIGS. 8-15. It will be appreciated that the box 138 may be employed alone as the towel support and/or in a general configuration need not be cooled.

FIG. 14 shows a side panel 140 which allows for further sponsor signs in addition to the display panels 116*a* and 116*b*. This side panel can be duplicated on both sides of the stand or just one side. It may be of any size, whether to allow view of the towel or to conceal it. The side panel 140 may be positioned slightly off the ground so that a ball boy's feet will be less likely to knock against the side panel 140 when placing the towel T on the towel support 18 from the side. Additionally, the side panel 140 could be hinged at one end, allowing them to be moved into, for example, a 45° angle to the back and front displays.

Figure 15:
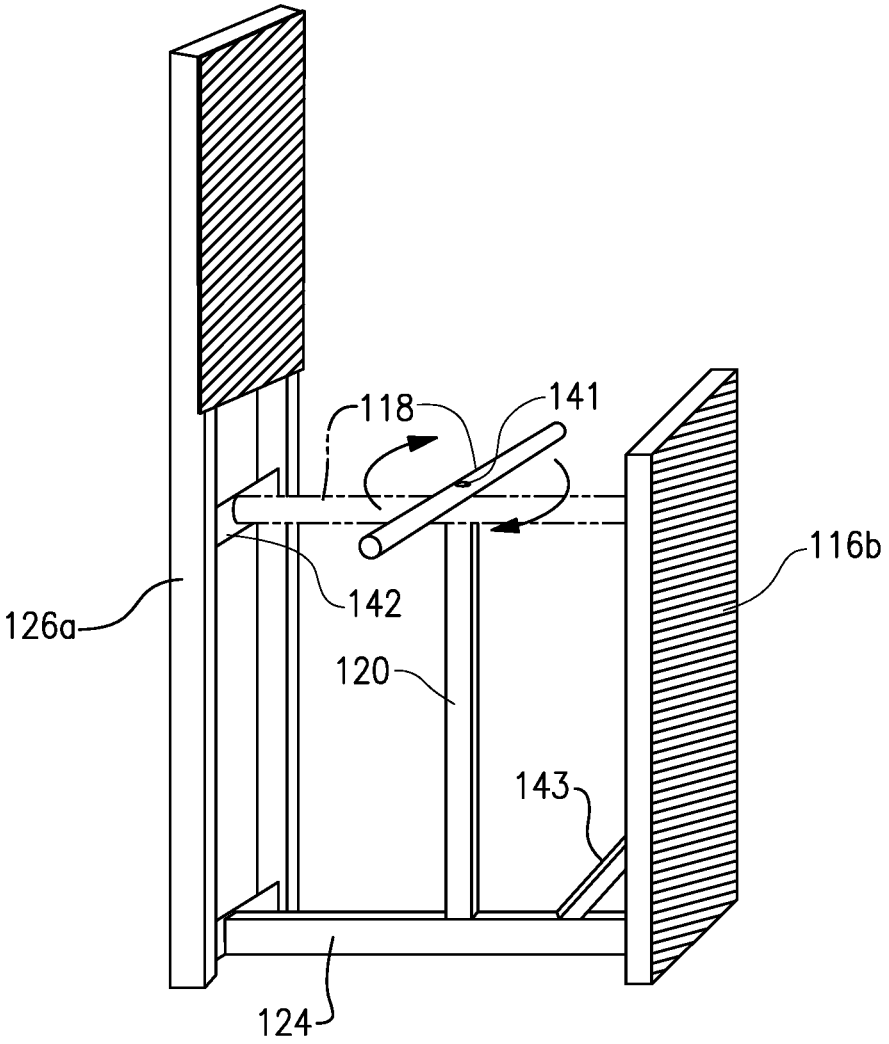
FIG. 15 is a side-perspective view of still another example towel rack with a rotatable towel support.

FIG. 15 shows towel support 118, as resting on support 120, which can be rotated to any position, preferably parallel or perpendicular to the display panels 116*a* and 116*b*, upon connector 141. By having the towel support 118 in the parallel position, the depth of the towel rack structure can be reduced substantially in circumstances where available space is limited. The bar 118, when in the perpendicular position, may be easily fixed to the back support for display panel 116*a* and to the back support for display panel 116*b*, for added stability during use or transport. Connector 141 allows for the bar 118 to click into place to secure its connection in at least the parallel and perpendicular positions (again relative to the display panels 116-116*b*). Support 143 may be used in various places to further provide stability for the electronic screens or printed signs. During transport, in order to position the towel rack 10 on court, wheels and/or brakes may be fitted to the towel rack 110 for ease of transportation. Furthermore, to increase stability, the front display panel 116*b* could be angled slightly backward (to a more acute angle with support 124) so as to work against it potentially tipping forward. This could actually improve the viewing angle since most speculators in the stadium and the televised camera angle are typically from high up.

Figure 16A:
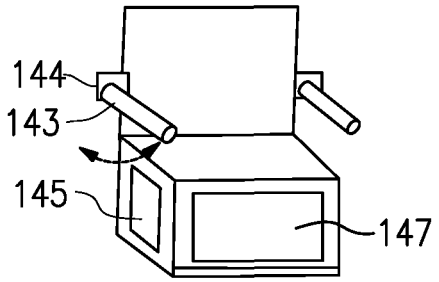
FIGS. 16*a*-16*b* are front views of an example line umpire chair incorporating a towel rack.
Figure 16B:
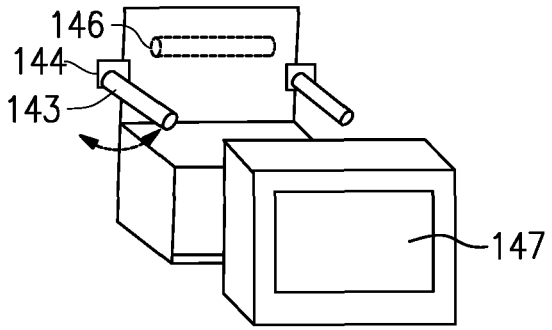

In FIGS. 16*a*-16*b*, the towel rack is shown incorporated into a line umpire chair. Towel supports 143, which can also act as an arm rest, can hold a towel. In order that the line umpire may sit on the chair, towel support 143 may swivel out upon hinge 144. Sponsor logos may be placed on the back or sides of the chair, as shown display 145. Additionally, a bar, box or basket can be attached to or positioned behind the back of the chair in circumstances where the ball boy assesses the time required to lay the towel over the towel support 118 as being too short, and therefore can quickly throw the towel into the receptacle. Towel support 146 may be placed on the back side of the chair or on the back side of the front display panel 147. It will be appreciated that particular elements of the towel rack ensemble can be detachable, however still retaining their function in the entirety of the invention. Moreover, in each of the configurations described herein, each element need not be physically connected in order to be a part of the invention. By way of example, the display screen for reasons of convenience need not be physically connected (i.e. mechanically attached, for example by bolt, hinge or screws) to the towel support in order to comprise the instant invention if the elements work together to perform the function as described herein.

Figure 17A:
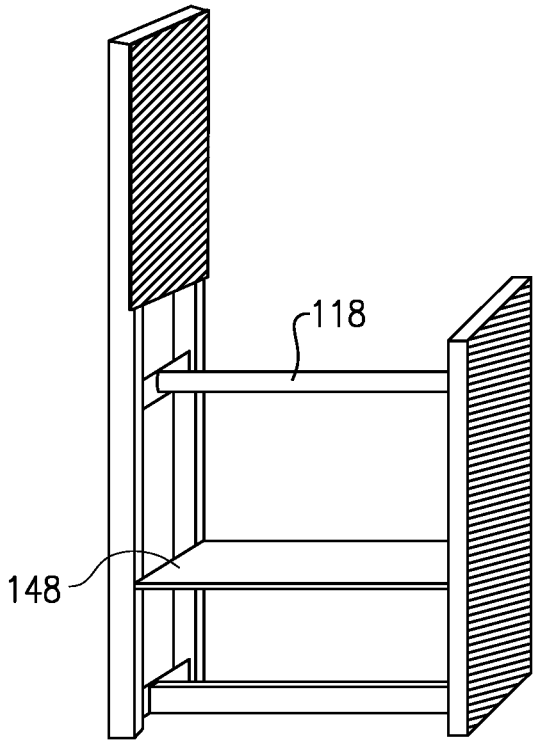
FIGS. 17*a*-17*b* are side-perspective views of still another example towel rack wherein the towel support is a towel panel.
Figure 17B:
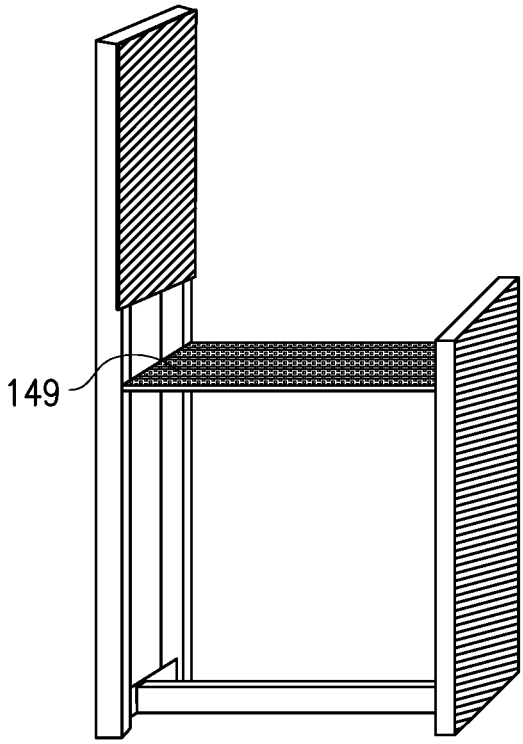

FIG. 17*a* shows the towel rack with a lower towel panel 148 which can be used to catch a towel which might fall off the towel support 118 if placed too hastily by the ball boy. FIG. 17*b* shows a towel rack which the towel panel is used with or in place of a towel support 118. Towel panel 149 may have small holes or slots, or can be a net or basket, so that the underside of the towel will be exposed to air, further facilitating drying.

While in one example the towel rack is positioned at the rear of a tennis court where the ball boy typically stands, the towel rack may be positioned at other locations, including for example adjacent to the players' benches/chairs on either side of the chair umpire.

Although the different examples have the specific components shown in the illustrations, embodiments of this disclosure are not limited to those particular combinations. It is possible to use some of the components or features from one of the examples in combination with features or components from another one of the examples. As previously discussed, each element need not be physically attached/ connected and may also be employed in close proximity in order to achieve the same function.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A towel rack for use during a sports event, comprising:

a support for supporting a towel; and at least one display panel displaying a message in the direction of a playing surface, wherein the at least one display panel is visible from at least a front perspective when a towel is placed on the support, wherein the at least one display panel extends from a point above the support to a point adjacent the playing surface such that the at least one display panel obscures a view of a vast majority of a towel placed on the support from at least the front perspective, wherein the at least one display panel includes a front display panel positioned in front of the support, wherein the at least one display panel includes a rear display panel positioned behind the support, and wherein the support is positioned such that a towel placed on the support does not obstruct the rear display panel, and wherein the front display panel is positioned such the front display panel does not obstruct the rear display panel.

2. The towel rack as recited in claim 1, wherein at least one of the front display panel and the rear display panel displays a shot clock.

* * * * *